US005538064A

United States Patent [19]

Salice

[11] Patent Number: 5,538,064

[45] Date of Patent: Jul. 23, 1996

[54] GUIDE RAIL SLIDINGLY SUPPORTING A LOAD BEARING MEMBER THEREIN

[75] Inventor: Luciano Salice, Novedrate, Germany

[73] Assignee: Arturo Salice S.p.A., Novedrate, Italy

[21] Appl. No.: 273,139

[22] Filed: Jul. 14, 1994

[30] Foreign Application Priority Data

Jul. 20, 1993 [DE] Germany ..... 43 24 340.1

[51] Int. Cl.[6] ..... E05D 15/26; E05D 15/06; A47H 15/00

[52] U.S. Cl. ..... 160/201; 160/199; 160/206; 160/213; 16/87 R; 16/91

[58] Field of Search ..... 160/196.1, 199, 160/201, 206, 207, 213; 16/87 R, 91, 90

[56] References Cited

U.S. PATENT DOCUMENTS

| | | | |
|---|---|---|---|
| 3,287,759 | 11/1966 | Foltz | 16/87 |
| 4,845,806 | 7/1989 | Hamacher | 16/88 |
| 4,991,257 | 2/1991 | Eutebach | 16/87 |
| 5,085,262 | 2/1992 | Tutikawa | 160/199 |

FOREIGN PATENT DOCUMENTS

| | | |
|---|---|---|
| 1960037 | 12/1971 | Germany . |
| 8400107 U | 6/1984 | Germany . |
| 9300918 U | 4/1993 | Germany . |
| 0610557 | 11/1993 | Germany . |
| 1258907 | 12/1971 | United Kingdom . |

*Primary Examiner*—Kenneth J. Dorner
*Assistant Examiner*—Bruce A. Lev
*Attorney, Agent, or Firm*—Jacobson, Price, Holman & Stern

[57] ABSTRACT

A guide rail has running surfaces separated by a longitudinal slit and a load bearing member carried by the same so that it may slide but not rotate and on it a closing element, preferably a door of a folding sliding door, is attached. In order to be able to secure the closing element carried by the load bearing member to the guide rail simply and quickly, the load bearing member has an elongated carriage part running in the guide rail and having a width corresponding to the longitudinal slit in the guide rail. In a hole, at a right angle to the guide rail, in the load bearing member a pin is mounted so that it may rotate but not move axially and adjacent to carriage part it has a T-head, whose width is less than the width of the longitudinal slit but whose length is greater than it. The pin is able to be locked to the load bearing member in a setting in which the head bears against the running surfaces.

12 Claims, 4 Drawing Sheets

GUIDE RAIL SLIDINGLY SUPPORTING A LOAD BEARING MEMBER THEREIN

FIELD OF THE INVENTION

The invention relates to a guide rail having running surfaces divided from one another by a longitudinal slit and a load bearing member supported thereon in a sliding and non-rotatable manner therein, on which a dependent closing element such as, more particularly, a leaf of a folding sliding door is attached.

BACKGROUND OF THE INVENTION

A folding sliding door comprising an upper guide rail, in which a roller load bearing member runs having attachment heads arranged with mutual bilateral symmetry, on which an arm of a hinge, which connects the outer door leaf with the roller carrying member, is able to be attached for movement to the left or the right as may be desired, is disclosed in the German Utility Model 8,400,107 U. The fitting of this known folding sliding door is an intricate operation, because the hinge arm must be connected with the roller load bearing member, is already held in the guide rail, without proper access to the parts.

In the case of the known guide rail in accordance with the German Utility Model 9,300,918 U of the type initially mentioned simpler fitting is possible because the load bearing member is provided with a locking device comprising detent levers, with which, by insertion with a catch effect of a connecting part provided with a pin, wings connected with the latter are able to be connected. For producing the catch connection with detent levers the pin is provided with a head able to be trapped by the latter. While this known design does enable rapid assembly to take place by simple insertion of the pin into the locking device with a catch effect, the detachment of the locking device is however difficult and furthermore the load bearing member and the connection part able to be fixed on it have a complex configuration in order to render the releasable catch effect possible.

SUMMARY OF THE INVENTION

One object of the invention is consequently to provide a guide rail of the sort noted initially, with which there is on the one hand a low-cost structure as defined hereinabove while on the other hand the closing element, borne by the load bearing member thereof, may be simply and quickly connected.

In accordance with the invention this object is to be attained since the load bearing member possesses an elongated carriage part running in the guide rail and having a width corresponding to the longitudinal slit, a pin is bearinged in the load bearing member in a hole at a right angle to the guide rail in a rotatable but axially fixed fashion, said pin having adjacent to the carriage part a T-shaped head, whose width is smaller than the width of the longitudinal slit and whose length is greater than the width of the longitudinal slit and the pin is adapted to be locked in a setting, in which the head thereof bears against the running surfaces.

The load bearing member in accordance with the invention possesses a simple configuration, because it essentially consists of an elongated carriage part running in the guide rail, which for the guidance thereof in the guide rail is provided with a rotatably mounted T-shaped or hammer-like head, whose limbs constitute, when turned into the transverse setting, the sliding shoes running on the guide rail. If the limbs of the T-head are set pointing in the longitudinal direction of the carriage part, they will then not extend out past the width thereof so that for the fitting and connection of the load bearing member in and with the guide rail the carriage part may be inserted through the longitudinal slit into the guide rail. Once such insertion has been performed, it is merely necessary to turn the pin using a simple actuating means through 90° so that the carriage part will be locked in the guide rail and the limbs of the T-shaped head will be supported as sliding shoes. The load bearing members in accordance with the invention may therefore be connected with the closing elements even prior to final assembly so that then only the insertion and locking in place of the carriage parts of the load bearing members in the guide rail is called for.

In keeping with yet another possible form of the invention a base part, which extends transversely in relation to the carriage part of the load bearing member, is connected with the carriage part, and transversely in relation to the guide rail, the hinge arm of a furniture hinge is able to be attached on the base part. This design in accordance with the invention creates a simple and readily fitted holding device for the respectively outer leaf of a folding sliding door.

On the base part it is possible for a support plate to be attached, on which the hinge arm is transversely guided for the adjustment thereof using a self-locking setting device. In this respect the guide may project out of aligned holes in the limbs, which are set at an angle, of the support plate, through which pins extend, which are secured in the angled limbs of the hinge arm. Furthermore, the self-locking setting device may comprise an eccentric drive, whose eccentric member is arranged in a slot in the flange part of the hinge arm.

The support plate may be mounted on the base part for longitudinal sliding movement and be able to be secured by an attachment screw, which extends through a keyhole-like slot. It is in this manner that simple adjustment in the longitudinal direction of the hinge arm is rendered possible.

Another advantageous feature of the invention is such that the attachment screw is at the same time a set screw for the pin having the T-head. Should the pin be located in a position, in which the limbs of the T -head rest as sliding shoes on the running surfaces of the guide rail, it will be locked in this position by further tightening of the attachment screw.

In accordance with a further advantageous development the pin is provided with an angled actuating part, which, in a position in which the T-head is transverse in relation to the longitudinal slit, rests against one flank of the base part. Using this attachment it is then simply and quickly possible to turn the T-head into its locking setting and then release it again also.

In accordance with a preferred embodiment the set and attachment screws are located on that side of the base part, which faces the adjoining body wall in the closed position of the sliding folding door. It is in this manner that, when the folding door is open, simple fitting and adjustment are possible.

In keeping with yet another possible form of the invention the carriage part has its forked limbs at both ends, into which in each case a pin bearing a roller is held and the rollers are located between the edges, delimiting the longitudinal slit, of the section of the guide rail. These rollers improve the running of the carriage parts in the guide rail.

In accordance with a more particularly preferred form of the invention the carriage part is made with bilateral symmetry about its vertical transverse plane and the load bearing member is bilaterally symmetrical with respect to the vertical longitudinal median plane thereof. This design provides a simple way of mounting on the left or the right, as is necessary in accordance with whether the left or the right door leaf is hinged on the body wall.

It is convenient if the T-head is bearinged in a central window-like opening through the carriage part.

The carriage part connected with the base part in an integral manner may include an injection molded synthetic resin component. Furthermore the T-head and the rollers may be manufactured of synthetic resin objection molded components.

BRIEF DESCRIPTION OF THE DRAWINGS

One working embodiment of the invention will now be described in more detail with reference to the drawings.

DETAILED DESCRIPTION OF THE PREFERRED EMBODIMENTS

Figure 1:
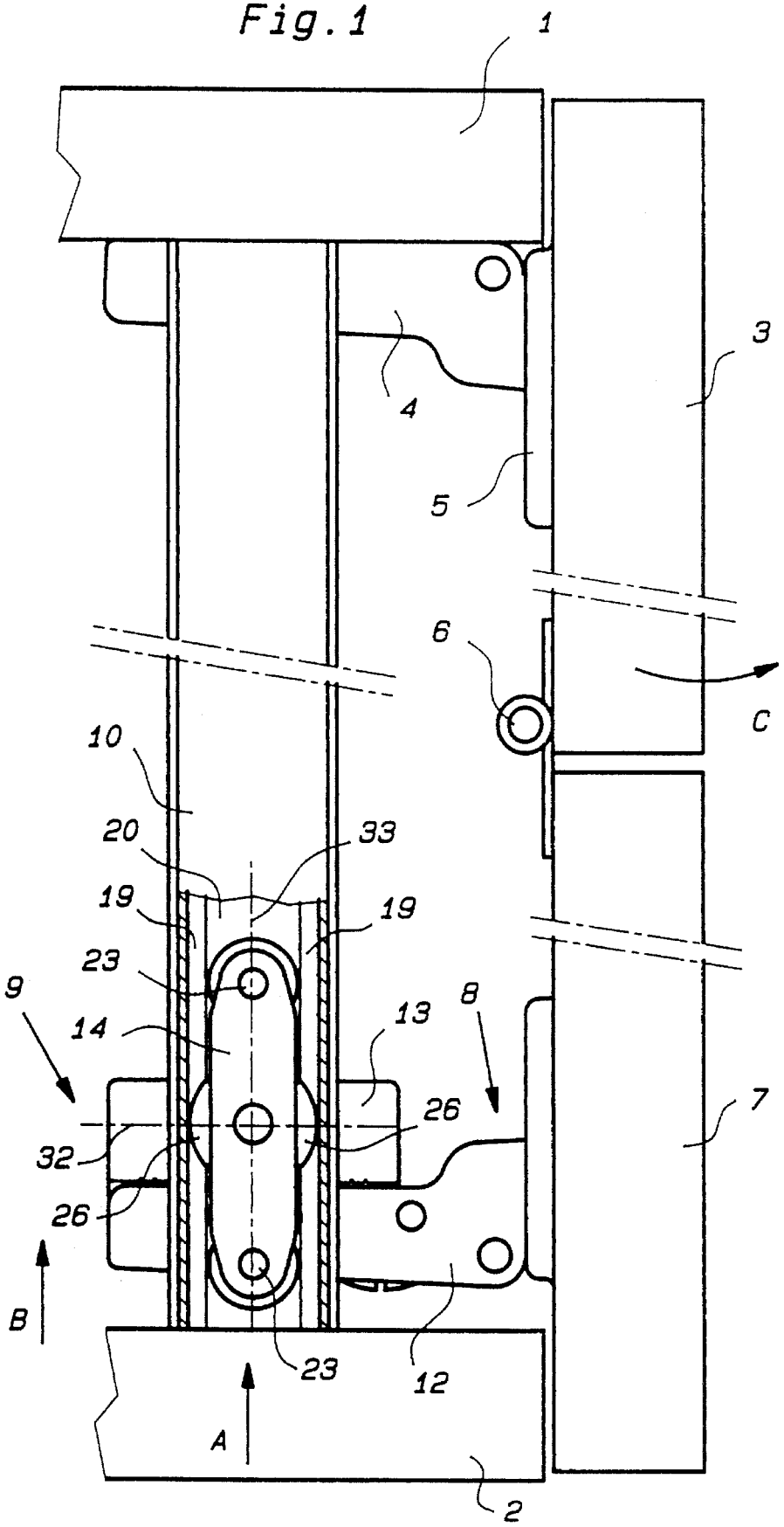
FIG. 1 is a plan view of a folding sliding door having a load bearing member in accordance with the invention, which bears the external door leaf and runs in a guide rail, the covering board of the piece of furniture having been removed.
Figure 2:
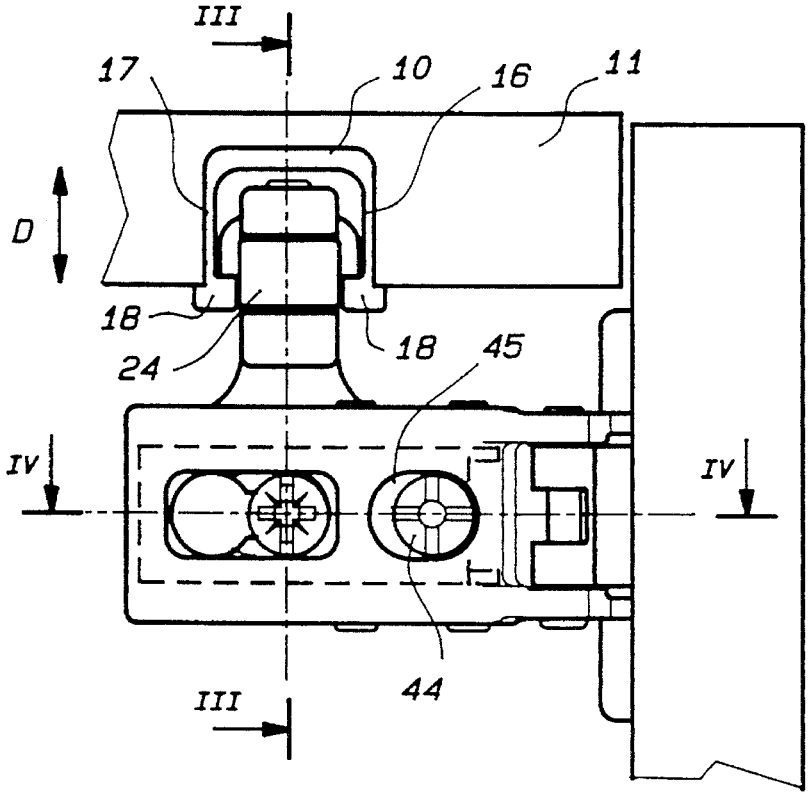
FIG. 2 is an elevation of the load bearing member, running in the guide rail, looking in the direction of the arrow A in FIG. 1, the side wall of the piece of furniture having been removed.

In FIG. 1 the reader will see a plan view of a piece of furniture having a folding sliding door. The top board is removed from the piece of furniture so that only the side walls 1 and 2 of the body part are to be seen. On the side wall 1 the internal door leaf 3 of the folding sliding door is hinge mounted by means of a conventional four joint hinge with two links, whose hinge arm 4 is secured to the inner side of the side wall 1 and whose pot-shaped hinge part 5 is secured in a corresponding recess in the door leaf 3. The inner door leaf 3 is connected by a conventional strap hinge 6 with the external leaf 7 of the folding sliding door. Adjacent to its outer end the door leaf 7 is connected by a four joint hinge 8, having two links, with a load bearing member 9, same running in a guide rail 10, which is secured to a covering board as indicated in FIG. 2, which in FIG. 1 is omitted in order to make the drawing more straightforward. The arm 12 of the hinge 8 is secured of the base part 13 to the load bearing member 9, which is integrally joined to the carriage part 14 running in the guide rail 10.

The guide rail 10 has, as may be best seen from FIGS. 1 and 2, a U-shaped cross section, from whose lateral limbs 16 and 17 flanges 18 are angled inward, which constitute internal running surfaces 19, whose adjacent end edges are separated from each other by a longitudinal slit 20.

On opening the folding sliding door the load bearing member 9 is displaced in the guide rail 10 in the direction of the arrow B, the internal door leaf 3 being pivoted in the direction of the arrow C and the external door leaf 7 being pivoted in the opposite direction.

Figure 5:
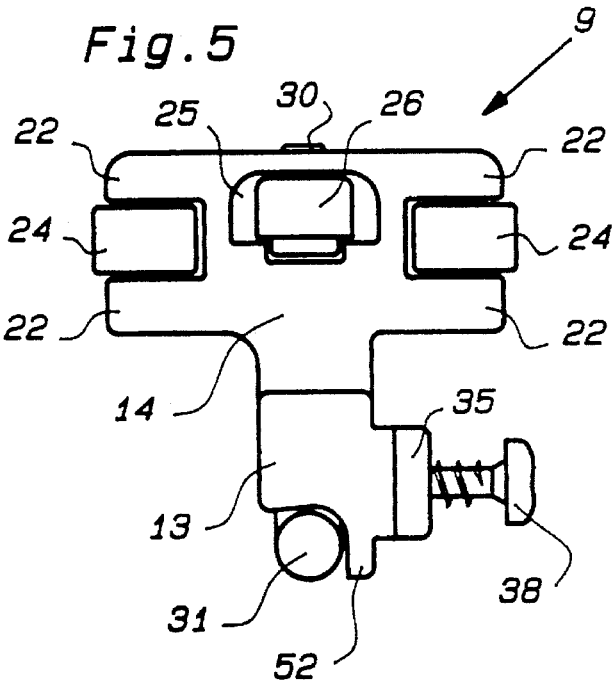
FIG. 5 is a side elevation corresponding to FIG. 3 of the load bearing member, the T-head being set transversely to the longitudinal slit.
Figure 8:
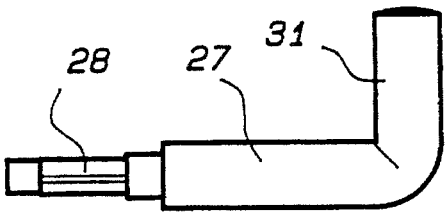
FIG. 8 is an elevation of the angled pin bearing the T-head.
Figure 9:
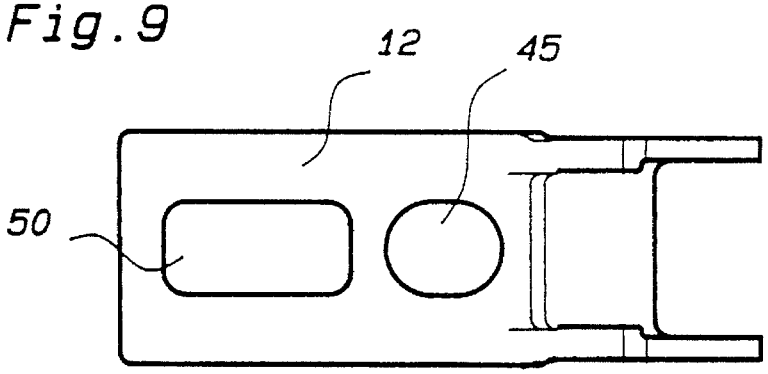
FIG. 9 is a plan view of the hinge arm.

The load bearing member 9 consists, as may best be seen from FIGS. 1 and 5, of an upper carriage part 14, which is constituted by an elongated block, which at its ends has forked limbs 22. The limbs 22 are provided with aligned holes, in which pins 23 are able to freely rotate and on which rollers 24 are secured, which are placed between the limbs 22. In its middle part the carriage part is provided with a window-like opening 25, in which a generally T-shaped or hammer-like head 26 is mounted rotatably on a pin 27 (FIG. 8).

Figure 6:
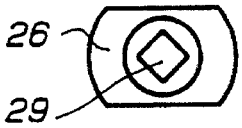
FIG. 6 is an elevation of the T-head constituting the sliding shoe.
Figure 7:
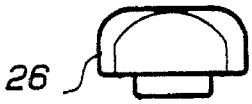
FIG. 7 is a side elevation of the T-head.

The holding part 9 is provided with a vertical hole, in which the straight shank of the pin 27 is rotatably bearinged. The pin 27 possesses an upper portion 28 with a square cross section, which extends through the square opening 29 (FIG. 6) in the T-head 26 so that the latter is non-rotatably mounted on the pin 27. At its upper end the pin 27 is provided with an end part able to be rivetted and having a hole therein, which after assembly is rivetted to hold the pin 27 in the hole with the formation of a rivet head 30. The pin 27 is provided with an angled part 31 at its lower end.

Figure 3:
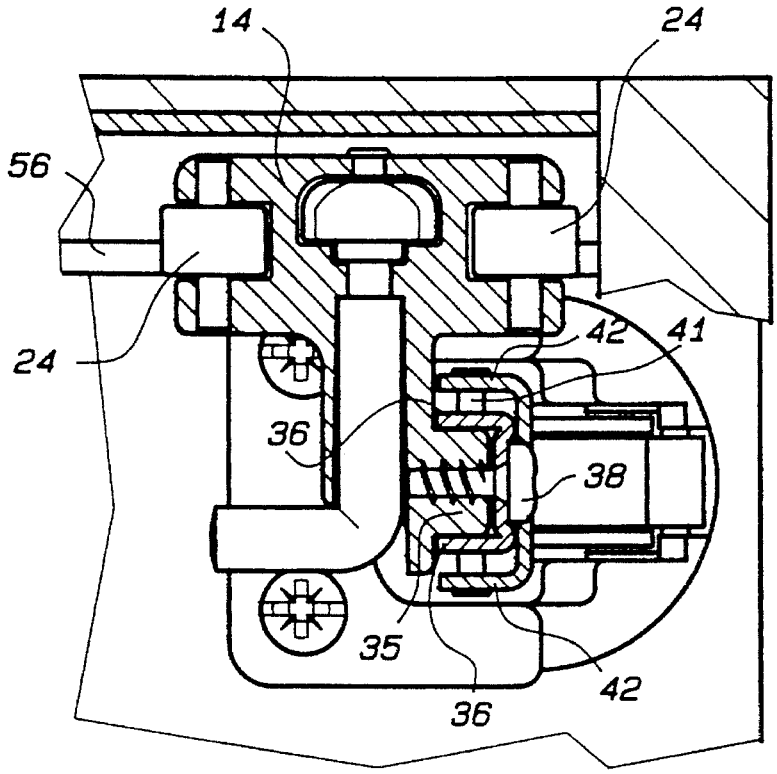
FIG. 3 is a section taken through the load bearing member on the line III—III of FIG. 2, the T-head being depicted in its setting rendering possible the insertion of the carriage part.
Figure 4:
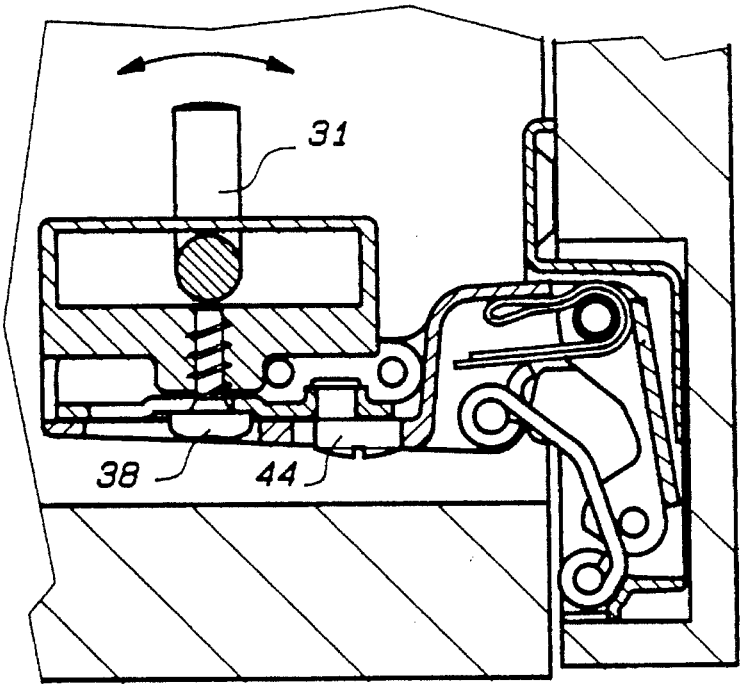
FIG. 4 is a section taken through the load bearing member and the hinge on the line IV—IV of FIG. 2.
Figure 10:
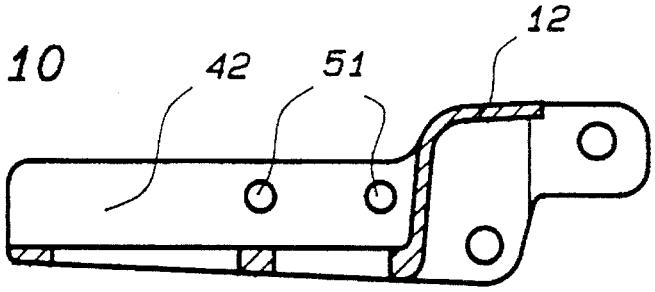
FIG. 10 is a longitudinal section taken through the hinge arm in accordance with FIG. 9.
Figure 11:
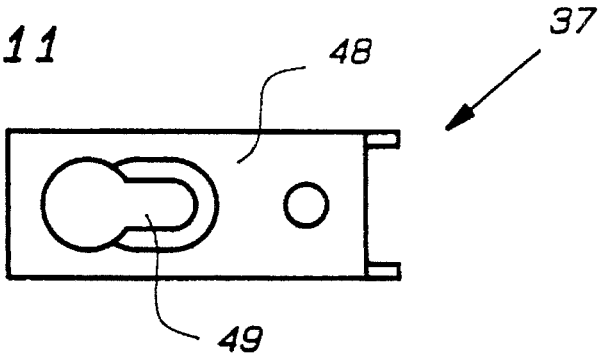
FIG. 11 is plan view of the support plate.
Figure 12:
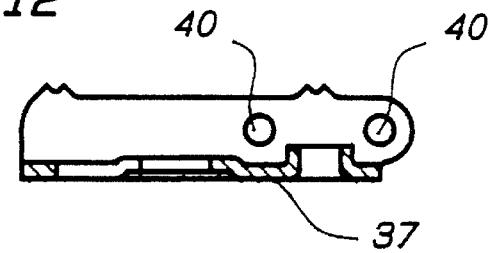
FIG. 12 is a longitudinal section taken through the support plate according to FIG. 11.

The upper carriage part 14 of the load bearing member 9 is designed symmetrically in relation to its transverse central plane 32 which extends perpendicular to the longitudinal axis 33. A base part 13 is integrally connected with the carriage-shaped part 14 and is perpendicular to the carriage-shaped part 14 so that the carriage part 14 and the base part 13 intersect with each other in the manner indicated in FIG. 1. The base part 13 is provided on one side with a ramp-like hump 35 (FIG. 3), whose lateral flanks are overlapped by the angled limbs 36 of a support plate 37 (FIGS. 11 and 12). The ramp-like hump 35 is provided in its middle part with a raised part having the configuration of a circular disk, through which there extends a hole for an attachment screw 38. To the side of this disk-like raised portion holes 40 are arranged in the limbs 36 of the support plate, which have two parallel pins 41 extending through them, said pins being secured in the angled limbs 42 of the hinge arm 12. On these parallel pins 41 the hinge arm is able to run in the direction of the arrow D with transverse sliding in relation to the support plate 37. For such transverse sliding the shank of an eccentric 44 is rivetted to the flange part 48 of the support plate, such eccentric being positioned in a slot 45 in the flange part of the hinge arm 12. The flange part 48 of the support plate 37 is provided with a keyhole-like slot 49, into which the attachment screw 38 fits. For fitting the head of the attachment screw 38, the attachment screw is inserted through the circular part of the slot, it being held by the narrow part of the slot. Adjustment of the hinge arm in its length direction is possible along the narrower slot-like part. In order to be able to turn the attachment screw 38 the flange part of the hinge arm 12 is provided with a rectangular window-like opening 50. In FIG. 10 the holes 51 in one limb 42 of the hinge arm 12 will be seen, in which the ends of the guide pins 41 are rivetted.

If the angled limb 31 of the pin 27 is at a right angle to the base part, then the limbs of the T-head 26 will be turned into the window-like opening 25 in the carriage part 14 so that they do not extend past the carriage part 14. In this condition the carriage part may then be pushed through the slit 20 in the guide rail 10. In the inserted condition the angled part 31 of the pin 27 is then turned through 90° so that it abuts the flank of the lateral flange 52 of the base part. In this setting the limbs of the T-head 26 will be transverse in relation to the carriage part 14 so that in the manner indicated in FIG. 1 the same may bear against the guide tracks 19 on the guide rail. In this position the carriage part 14 is hence locked in the guide rail so that the limbs of the T-head 26 constitute the sliding shoes bearing the load bearing member. In this locked position the rollers 24 are between the mutually adjacent end edges of the running surfaces in the guide slit 20 in the manner indicated in FIG. 3. Torque transmitted to carriage part 14 from the hinge arm is transmitted to end edges 56 of the running surfaces without substantial increase of the frictional forces.

I claim:

1. A guide rail comprising running surfaces divided from one another by a longitudinal slit and a load bearing member supported therein for sliding without rotation and for receipt of a leaf of a folding sliding door, said load bearing member including an elongated carriage part running in the guide rail and having a width corresponding to the longitudinal slit in the guide rail, a pin mounted on said load bearing member in a hole at a right angle to the guide rail in a rotatable and axially fixed position, said pin having in said carriage part a T-shaped head, a width of said head is smaller than a width of said longitudinal slit and a length of said head is greater than the width of the longitudinal slit and said pin is adapted to be locked to the load bearing member in a setting, in which the head bears against said running surfaces.

2. The guide rail as claimed in claim 1, wherein a base part extends transversely to said carriage part of the load bearing member and is connected to said carriage part transversely in relation to the guide rail, and a hinge arm of a furniture hinge is attachable to said base part.

3. The guide rail as claimed in claim 2, wherein a support plate is attached to said base part for adjustment thereof of the hinge arm.

4. The guide rail as claimed in claim 3, wherein the support plate is mounted on the base part for longitudinal sliding movement by an attachment screw extending through a slot in a flange part of the support plate.

5. The guide rail as claimed in claim 4, wherein the attachment screw also acts as a set screw for the T-head.

6. The guide rail as claimed in claim 5, wherein a pin is provided with an angled attachment part, which, in a position in which the T-head is transverse in relation to the longitudinal slit, rests against one flank of the base part.

7. The guide rail as claimed in claim 2, wherein the carriage part is connected with the base part in an integral manner.

8. The guide rail as claimed in claim 4, wherein said attachment screw is located on a side of the base part, which faces an adjoining body wall in a closed position of the sliding folding door.

9. The guide rail as claimed in claim 1 wherein the carriage part includes forked limbs at both ends, and a pin bearing a roller is held in each of said forked limbs and the rollers are located between edges delimiting the longitudinal slit.

10. The guide rail as claimed in claim 9, wherein the T-head and the rollers are manufactured of synthetic resin components.

11. The guide rail as claimed in claim 1, wherein the carriage part is bilaterally symmetrical about a vertical transverse plane thereof and the load bearing member is bilaterally symmetrical with respect to a vertical longitudinal median plane thereof.

12. The guide rail as claimed in claim 1 wherein the T-head is mounted in a central opening through the carriage part.

* * * * *